US010118065B2

(12) United States Patent
Hollingshead

(10) Patent No.: US 10,118,065 B2
(45) Date of Patent: Nov. 6, 2018

(54) SPACER FOR BARBELLS AND WEIGHTED PLATES

(71) Applicant: David Hollingshead, Livonia, NY (US)

(72) Inventor: David Hollingshead, Livonia, NY (US)

( * ) Notice: Subject to any disclaimer, the term of this patent is extended or adjusted under 35 U.S.C. 154(b) by 0 days.

(21) Appl. No.: 15/181,849

(22) Filed: Jun. 14, 2016

(65) Prior Publication Data

US 2017/0113088 A1 Apr. 27, 2017

Related U.S. Application Data

(60) Provisional application No. 62/246,823, filed on Oct. 27, 2015.

(51) Int. Cl.
*A63B 21/072* (2006.01)
*A63B 21/075* (2006.01)
*A63B 21/078* (2006.01)

(52) U.S. Cl.
CPC ..... *A63B 21/075* (2013.01); *A63B 21/0724* (2013.01); *A63B 21/0728* (2013.01); *A63B 21/0783* (2015.10)

(58) Field of Classification Search
CPC ..... A63B 21/06–21/08
USPC ..... D21/680–681
See application file for complete search history.

(56) References Cited

U.S. PATENT DOCUMENTS

D433,721 S * 11/2000 Rojas ..... D21/680
6,319,176 B1 * 11/2001 Landfair ..... A63B 21/06 482/106
6,991,590 B2 * 1/2006 Vigiano ..... A63B 21/06 482/106
2007/0135271 A1 * 6/2007 Lien ..... A63B 21/0724 482/93
2011/0319233 A1 * 12/2011 Ross ..... A63B 21/075 482/93

* cited by examiner

*Primary Examiner* — Jennifer M Deichl
(74) *Attorney, Agent, or Firm* — Bond Schoeneck & King, PLLC; David Nocilly; George McGuire

(57) ABSTRACT

A spacer that is preferably made from high density polyethylene and has a diameter that is larger than a standard plate for a barbell. The spacer has a central hole dimensioned to accept a standard barbell and, when placed onto a barbell, will space the barbell apart from the ground a sufficient distance that a user can easily add or more plates from the barbell without having the lift the barbell. The spacer provides a more efficient way to add or remove weights from a barbell that is on the ground (e.g., when a user is performing deadlifts, snatches, and power cleans, etc.). The spacer may be placed on a barbell similarly to a regular weight plate, preferably before any other weight is added.

7 Claims, 4 Drawing Sheets

SPACER FOR BARBELLS AND WEIGHTED PLATES

CROSS-REFERENCE TO RELATED APPLICATIONS

The present application claims priority to U.S. Provisional Application No. 62/246,823, filed on Oct. 27, 2015.

BACKGROUND OF THE INVENTION

1. Field of the Invention

The present invention related to weightlifting equipment and, more particularly, to a barbell accessory that spaced the barbell a sufficient distance from the ground to allow for the additional and removal of weights without having to lift the barbell.

2. Description of the Related Art

Weightlifting equipment generally comprises an elongated barbell and a series of weighted plates or bumper plates having central holes that are used to position the plates over the ends of the barbell. Plates are provided in various weights so that a user can combine the plates in various combinations to selectively control the amount of weight on the barbell. In order to add or remove the plates, however, a user must lift one end of the barbell so that the end is a sufficient distance from the ground to accept the plate. As a result, a user has to manipulate the barbell with one hand while trying to lift the plate with the other hand so that the hole aligns axially with the end of the barbell and the plate can be slid onto or off or onto the barbell. As plates can weight upwards of 45 pounds, changing the weights on a barbell is an unduly cumbersome task and wastes time that could otherwise be spent exercising. Accordingly, there is a need in the art for a system that can improve the ease by which weights may be added to or removed from a barbell.

BRIEF SUMMARY OF THE INVENTION

The present invention is a spacer for a barbell formed from a disc having a central hole formed therethrough, an outer perimeter defining a predetermined diameter that is greater than a diameter of a standard weightlifting plate. A series of ribs are formed into a first side of the disc. A series of shoulders are formed into a second side of the disc to define a corresponding series of nested depressions extending circumferentially about the central hole. The series of nested depressions have a series of diameters, respectively, which correspond to the outer diameters of a series of standard weightlifting plate. The invention also includes a method of changing weight plates on a barbell, comprising the steps of positioning first and second discs on either end of a barbell, wherein each disc has a central hole formed therethrough that receives one of the ends of the barbell, an outer perimeter defining a predetermined diameter that is greater than a diameter of a standard weightlifting plate, and a series of ribs formed into a first side of the disc, and then sliding the at least one weight plate onto or off of the barbell without lifting the barbell from the ground. The method may further comprise the step of positioning the at least one weight plate within one of the series of nested depressions.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
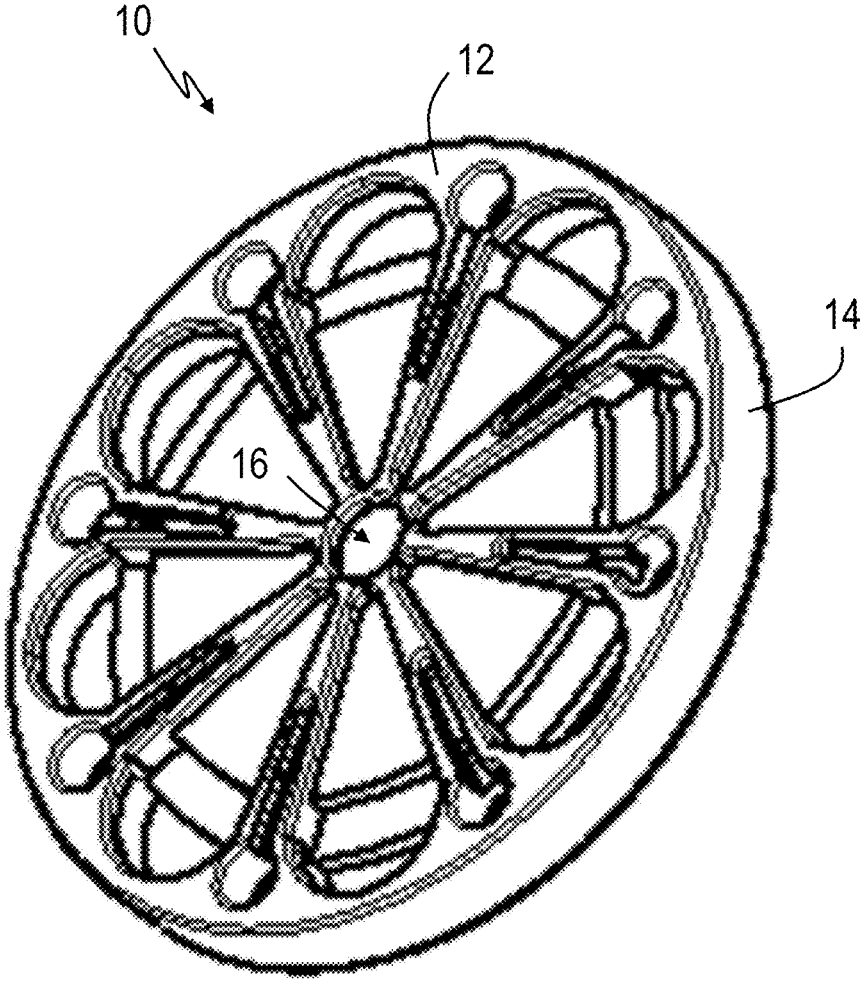
FIG. 1 is a first perspective view of a spacer according to the present invention.

Referring to the figures, wherein like numerals refer to like parts throughout, there is seen in FIG. 1 a spacer 10 according to the present invention. Spacer 10 comprises a disc 12 having an outer perimeter 14 and a hole 16 formed through the middle of disc 12. Hole 16 is dimensioned to accept a standard barbell therethrough, e.g., 50 millimeters or two inches. A plurality of ribs 12 extend along one side of disc 12 from central hole 16 to outer perimeter 14 to provide rigidity to spacer 10 without adding a significant amount of weight.

Figure 2:
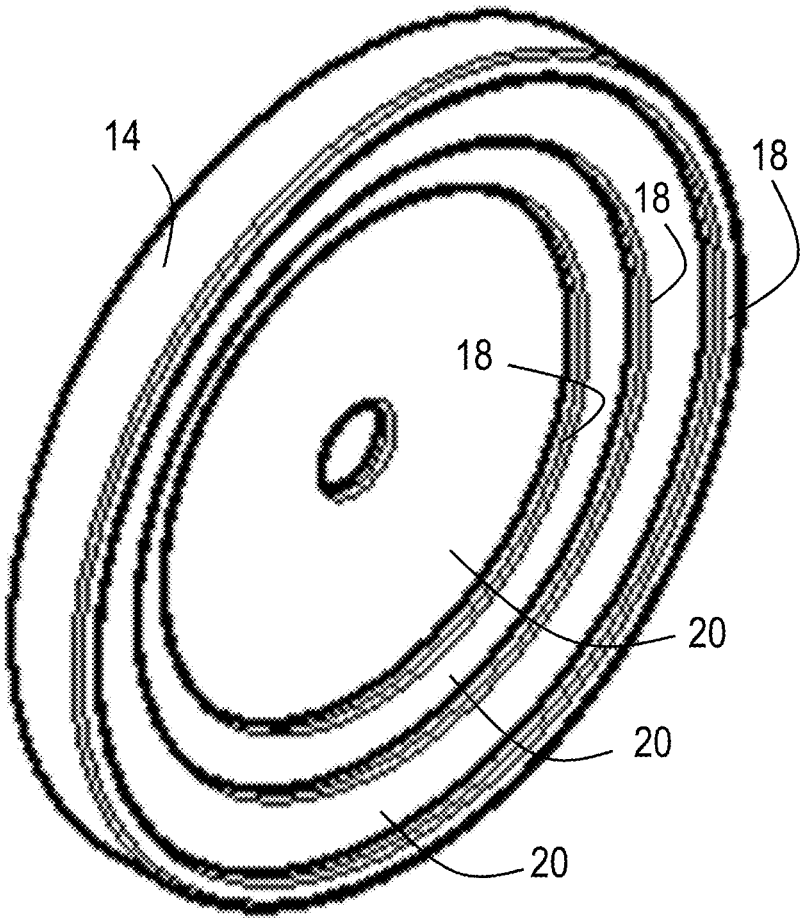
FIG. 2 is a second perspective view of a spacer according to the present invention.
Figure 3:
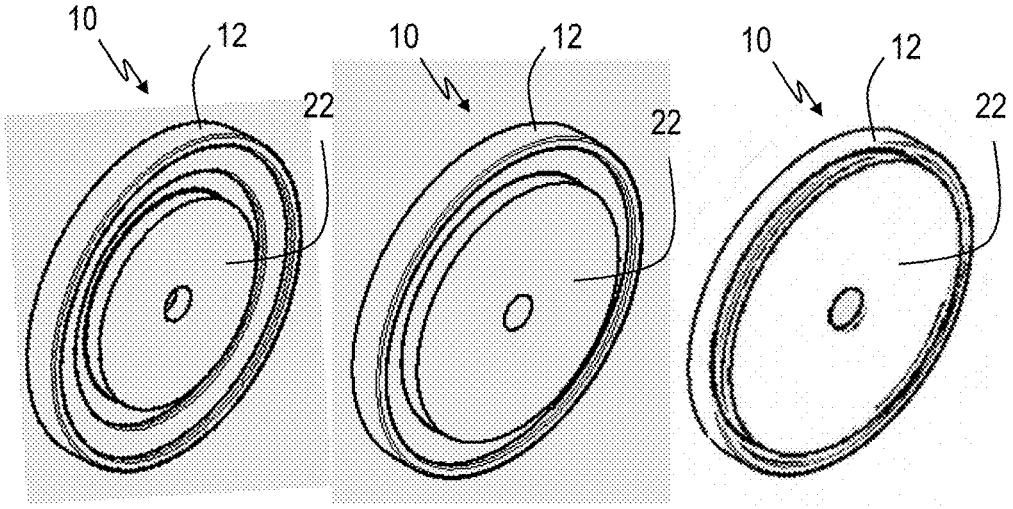
FIG. 3 is a series of front perspective views of a spacer accommodating different size weight plates according to the present invention.

Referring to FIG. 2, the opposing side of spacer 10 includes a series of shoulders 18 that define a series of concentric depressions 20 having gradually smaller diameters. Preferably, each shoulder 18 defines a depression 20 having a depth of one-half inch to securely accommodate a standard plate. As seen in FIGS. 3A through 3C, standard size weight plates 22 having different diameters can be positioned in the appropriate depression 20 to reduce the amount of space along a barbell that spacer 10 occupies and prevent movement of plates during use. For example, spacer 10 may include depressions having diameters of 12 inches, 14.5 inches, and 17.75 inches, and has an overall diameter of 19.25 inches. It should be recognized by those of skill in the art that these dimensions accommodate a 10 pound plate, a 25 pound plate, and a 45 pound plate in an Olympic style of plates and that any other dimensions could be provided to accommodate a different style or weight of plate.

Figure 4:
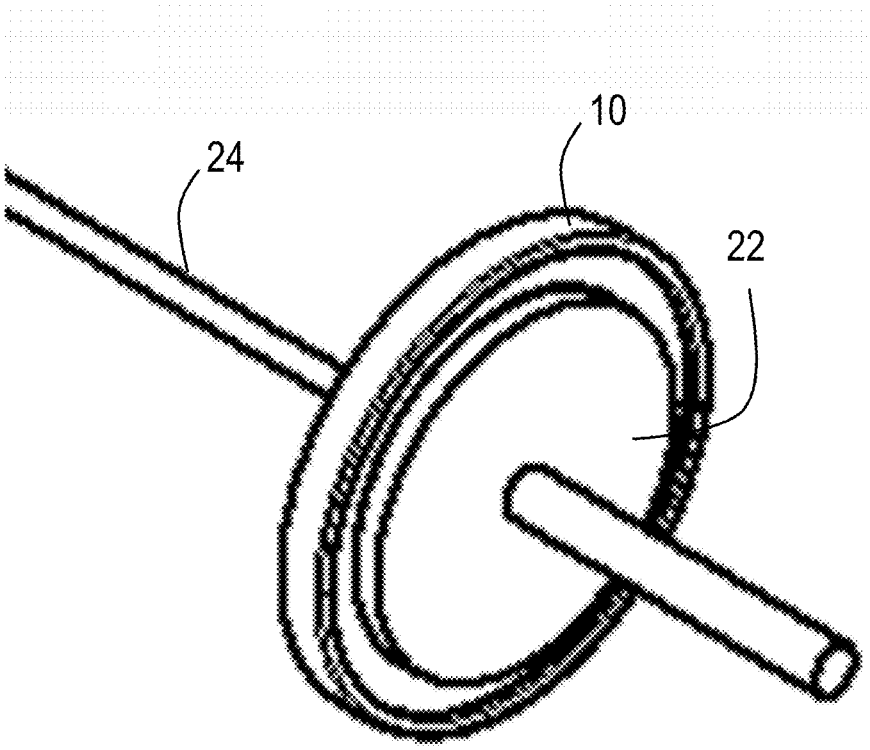
FIG. 4 is a perspective view of a pair of spacers on a barbell according to the present invention positioned on a barbell.

Referring to FIG. 4, spacer 10 may be positioned at either end of a barbell 24 by positioning disc 12 over the end of barber 24 using hole 16 to establish a ground clearance that allows a user to easily and much more efficiently take weights 22 on and off the barbell. For example, a spacer 10 having a diameter of about 19.25 inches will provide a one-quarter inch ground clearance when used with the largest diameter plates. Spacer 10 can be made from a polymer such as high density polyethylene so that the overall weight is less than 2.5 pounds yet rigid enough that, when paired with another spacer 10 positioned on the other end of barbell 24, can support a significant amount of weight, i.e., over 400 pounds. As a result, the use of two spacers 10 will not significantly impact the amount of weight on barbell 24. More importantly, the user will not have to struggle to lift barbell 24 (and any weights thereon) while adding or removing plates. A lifter can then focus on the lift rather than struggling with plate changes. This improved efficiency allows a user to cut down the time between sets, allowing the user to gain more from his or her workout.

What is claimed is:

1. A spacer for a barbell, comprising:

a disc having a central hole formed therethrough and an outer perimeter defining a predetermined diameter that is greater than a diameter of a weightlifting plate;

a series of ribs formed into a first side of the disc that extend from the central hole to the outer perimeter; and a series of shoulders formed into a second side of the disc that define a corresponding series of nested depressions extending completely circumferentially about the central hole.

2. The spacer of claim 1, wherein the series of nested depressions have a series of inner diameters, respectively, which correspond to a series of outer diameters of different weight weightlifting plates.

3. The spacer of claim 1, wherein the outer perimeter of the disc has an overall diameter of 19.25 inches.

4. A method of changing weight plates on a barbell, comprising the steps of:

positioning first and second discs on either end of a barbell, wherein each disc has a central hole formed therethrough that receives one of the ends of the barbell, an outer perimeter defining a predetermined outer diameter that is greater than an outer diameter of a weightlifting plate, a series of ribs formed into a first side of the disc that extend from the central hole to the outer perimeter, and a series of shoulders formed into a second side of the disc that define a corresponding series of nested depressions extending completely circumferentially about the central hole; and sliding at least one weight plate onto or off of the barbell without lifting the barbell from the ground.

5. The method of claim 4, wherein the series of nested depressions have a series of inner diameters, respectively, which correspond to a series of outer diameters of different weight weightlifting plates.

6. The method of claim 5, further comprising the step of positioning the at least one weight plate within one of the series of nested depressions.

7. A spacer for a barbell, comprising:

a disc having a central hole formed therethrough and an outer perimeter;

a series of ribs formed into a first side of the disc that extend from the central hole to the outer perimeter; and a series of at least three shoulders formed into a second side of the disc that define a corresponding series of nested depressions that extend circumferentially and completely about the central hole and have diameters of 12 inches, 14.5 inches, and 17.75 inches, respectively.

* * * * *